United States Patent [19]

Cardoso

[11] Patent Number: 4,827,627

[45] Date of Patent: May 9, 1989

[54] APPARATUS AND METHOD FOR CONTROLLING A DRYING CYCLE OF A CLOTHES DRYER

[75] Inventor: Frank M. Cardoso, New Bedford, Mass.

[73] Assignee: American Dryer Corporation, Fall River, Mass.

[21] Appl. No.: 158,496

[22] Filed: Feb. 22, 1988

[51] Int. Cl.[4] ..... F26B 21/10

[52] U.S. Cl. ..... 34/44; 34/48; 34/55; 34/53

[58] Field of Search ..... 34/44, 48, 53; 236/10; 237/53; 364/505, 506

[56] References Cited

U.S. PATENT DOCUMENTS

| | | | |
|---|---|---|---|
| 3,510,957 | 5/1970 | Jarvis | 34/53 |
| 4,286,391 | 9/1981 | Gerry | 34/44 |
| 4,520,259 | 5/1985 | Schoenberger | 34/48 X |
| 4,537,345 | 8/1985 | Brown | 237/53 X |

*Primary Examiner*—Henry A. Bennet

*Attorney, Agent, or Firm*—Pollock, Vande Sande & Priddy

[57] ABSTRACT

An apparatus for generating a drying cycle for a clothes dryer. A temperature sensor is positioned in the clothes dryer to continuously measure the temperature of hot air entering the clothes dryer. A microprocessor reads a signal from the temperature sensor and enables and disables a burner for supplying the hot air. The burner is enabled each time a measured temperature is below a predetermined set point temperature. When the temperature is at or above the set point temperature, the burner is disabled. The burner will continuously cycle to maintain the hot air at the predetermined temperature. The microprocessor is also programmed to periodically compute a dryness level for the clothes from the average on and off times of the burner. A signal is generated to indicate the end of the drying cycle when a predetermined dryness level has been detected.

10 Claims, 6 Drawing Sheets

TEMP./TIME

HEAT/TIME

TIME-ON MINUS TIME-OFF CYCLE

DRYNESS LEVEL/CYCLE

APPARATUS AND METHOD FOR CONTROLLING A DRYING CYCLE OF A CLOTHES DRYER

The present invention relates to apparatus for drying clothes with heated air. Specifically, a controller is described which would establish a precise drying cycle to obtain a desired dryness level.

Conventional clothes dryers comprise a tumbling chamber into which a load of wet clothing is inserted. The chamber includes a tumbler which is rotated to effect tumbling of the clothes. A stream of hot air is forced through the tumbler, which, over a given time cycle, removes the moisture contained in the clothing.

The proper drying of a load of wet clothing must avoid the consequences of overdrying. As is well known, overdrying risks scorching of the fabric, as well as wrinkling. In addition, overdrying the clothes is not fuel efficient.

Prior art clothes dryers set a drying cycle based upon an estimate of an appropriate drying time. Usually the operator will set a timer to a drying time which is based on human experience. At the conclusion of the drying time, the operator will check to see if the clothes are sufficiently dry. If not, a shorter timing cycle will be set, at the end of which the operator again checks the dryness of the clothing.

Both overdrying and underdrying reduces the machine throughput. This is especially disadvantageous in a commercial setting where the machine is continuously run, where production volume depends on an efficient drying cycle, and where fuel efficiency is necessary for economic drying of the clothing load.

Sensing the actual required time to dry a given load of wet clothing to a predetermined moisture content is made difficult by a number of factors. Among these include the size of the load being dried. It is very difficult for a human operator to estimate differences in drying time versus load sizes. Any changes in the availability of the temperature of the drying air will also affect the drying time.

Since the introduction of mechanical timers set by the operator to establish drying time, various techniques have been attempted for estimating the dryness of a load, from which an estimated drying time is computed. These include apparatus such as is described in U.S. Pat. No. 4,112,589 which estimates dryness on the basis of the amount of power consumption of an electrically heated clothes dryer. When the power consumption reaches a threshold, the drying cycle is ended.

U.S. Pat. No. 4,622,759 describes a clothes dryer which computes drying time based on the rate of change of an exhaust temperature for the dryer. When the rate of change reaches a predetermined value, this is used as an indication of the dryness level, ending the drying cycle.

U.S. Pat. No. 3,510,957 describes a dryer control system which counts the number of times a hot air heater is turned on and off to maintain a desired temperature. After a predetermined accumulated total of on and off times, the machine will enter a final drying cycle.

The present invention is also directed to the problem of establishing an optimum drying time based on a measured dryness level of a load being dried.

SUMMARY OF THE INVENTION

It is an object of this invention to establish an optimum drying cycle for a clothes dryer.

It is a specific object of this invention to determine an optimum drying cycle based on real time estimates of the dryness of a load of clothing being dried.

It is yet another object of this invention to determine an optimum drying cycle which is independent of the clothing load size, clothing content and availability of drying heat.

These and other objects are achieved by a method and apparatus in accordance with the invention. In order to achieve a precise drying cycle, the drying temperature is established for the clothes dryer at a precision set point. The source of heat supplying heated air to the load of clothes being dried is continually cycled on and off to maintain the drying temperature at the set point.

Control over the drying temperature is maintained by monitoring the temperature of the exhaust air exiting the drying chamber. A temperature sensor is preferably located in the exhaust port of the dryer, and gives an accurate indication of the drying temperature within the chamber. A microprocessor continuously monitors the temperature sensor, and an enabling signal is supplied to the burner each time the temperature sensor indicates an average temperature below the set point temperature. Each time the drying chamber temperature is determined to be above the set point, the burner is disabled, permitting the drying chamber with the load of clothing to cool down to the set point temperature.

Additional to maintaining the drying temperature constant, a real time dryness level is continuously computed during the time the burner is being cycled on and off. Each on and off cycle of the burner is stored in a memory by the microprocessor. Computations of the real time dryness level for the load of clothes is computed based on the stored on and off times for the burner. Preferably, the on and off times for several cycles of burner operation are averaged, and the difference between on and off times used to compute an effective dryness level for the load. This dryness level in a preferred embodiment is expressed as an equation, $$\frac{Ts}{a} + b - \text{(time difference)}.$$

The term Ts represents the set point temperature and a and b are thermal coefficients for a particular machine. These constants would typically lie in the range of 2–9, and 50–81, respectively.

The computed dryness level for the clothing load may be continuously compared to a desired dryness level which could be up to 100% dryness. Once a computed dryness level is determined to be equal to the desired dryness level, the drying cycle is at an end, and the dryer may then enter a terminating phase, such as a cool down cycle, or other concluding drying cycle known in the art.

DESCRIPTION OF THE PREFERRED EMBODIMENT

Figure 1:
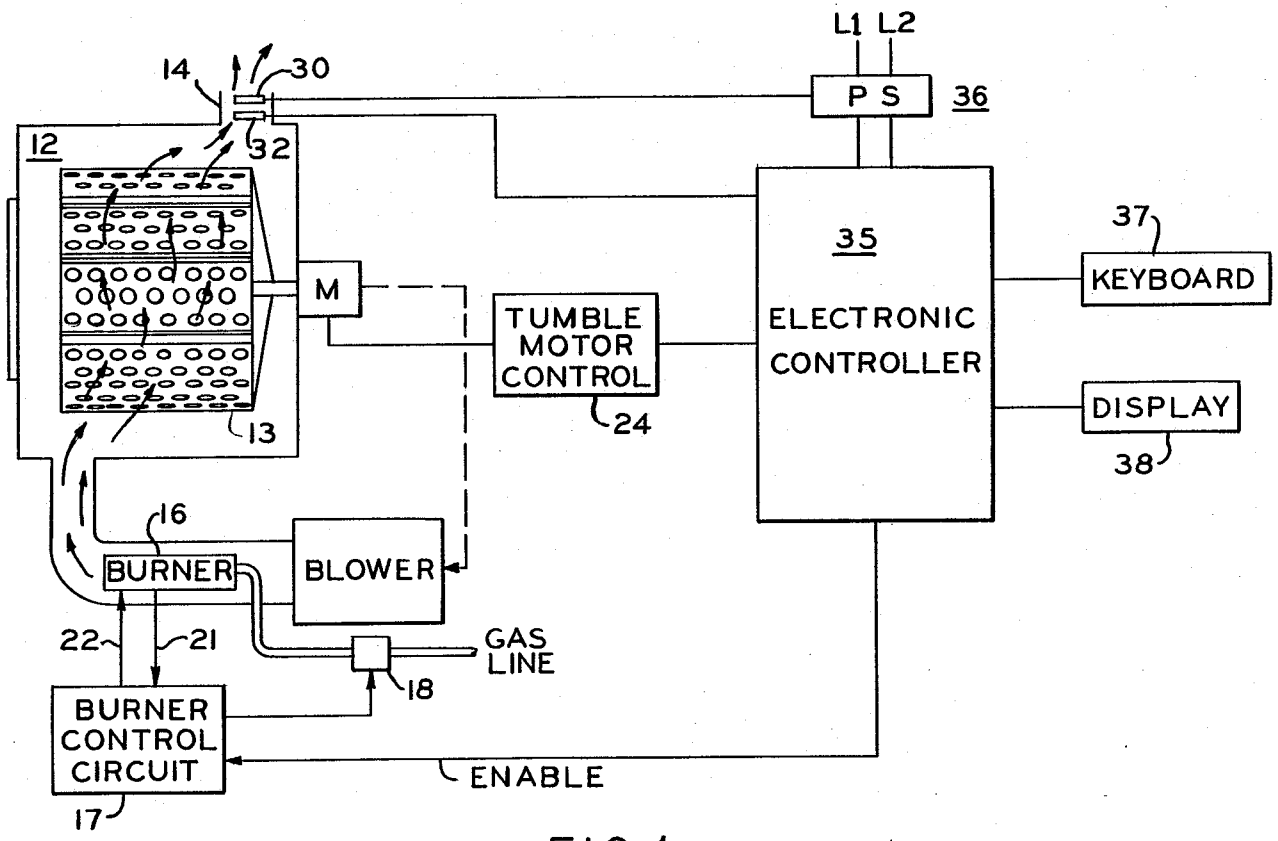
FIG. 1 is an overall block diagram illustrating the configuration of a preferred embodiment of the invention for establishing a drying cycle.

Referring to FIG. 1, there is shown an embodiment of the invention which will control the temperature and dryness of a load of clothing in a dryer chamber 12. Dryer chamber 12 is seen to comprise a tumbler 13 having a plurality of paddles for tumbling the clothing load. Around the surface of the drying chamber 12 is an air distributor 11 which supplies air to the clothing chamber 12, heated by burner 16. The hot air laden with moisture exits an exhaust port 14.

An electronic controller 35 will enable the tumbler motor control 24 at the initiation of a drying cycle. The tumbler motor control is, of course, known in the art, and further description is unnecessary. The burner control module 17 will enable solenoid 18 to supply a gas fuel to the burner 16. An igniter line 22 will provide an ignition source for the gas. A flame sensing line 21 provides feedback to the burner control circuit 17. These ignition line 22 and sensing line 21 are, of course, known in the burner control art. The burner control circuit 17 receives an ENABLE and DISABLE signal from the controller 35.

A keyboard 37 and display 38 are used to interface the operator to the electronic controller 35. As will be apparent with respect to FIG. 3, the electronic controller includes a programmable microprocessor, which can read keyboard commands from keyboard 37, as well as display various computed parameters in display 38.

A power supply 36 supplies the operating voltage to the electronic controller 35. Power supply 36 is interlocked with a safety interlock 30, shown in the exhaust 14 of the dryer. In the event of a catastrophic failure and a fire condition, safety interlock 30 will interrupt the power supply 36. This standard safety feature is industry-wide and also needs no further explanation.

A temperature sensor 32 is shown in the exhaust 14 which will give an accurate measurement of the drying temperature for the air in chamber 12. The electronic controller 35, through the use of the microprocessor, will continuously read out values of temperature for the drying chamber 12, and based on the temperature readings, compare them with a known set point which has been preprogrammed in the electronic controller 35. The relationship between the sensed temperature from sensor 32 and set point versus burner control signal is shown more particularly in FIGS. 2A and 2B.

Figure 2A:
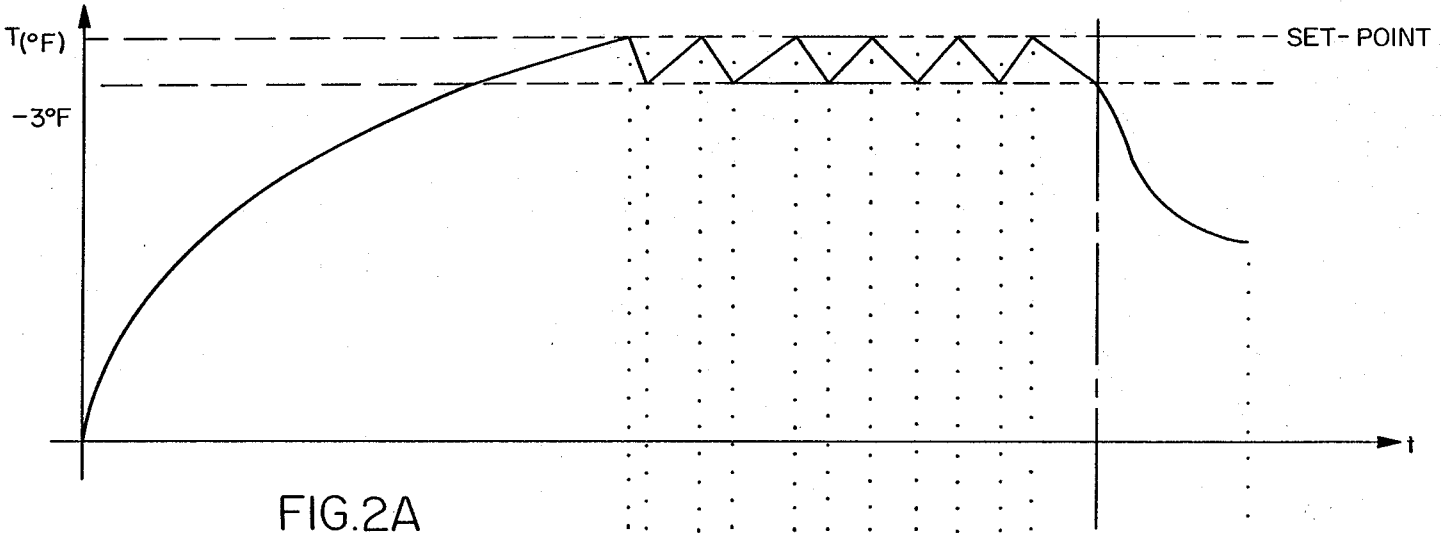
FIG. 2A illustrates the change in temperature over time versus the set point temperature during a drying cycle.
Figure 2B:
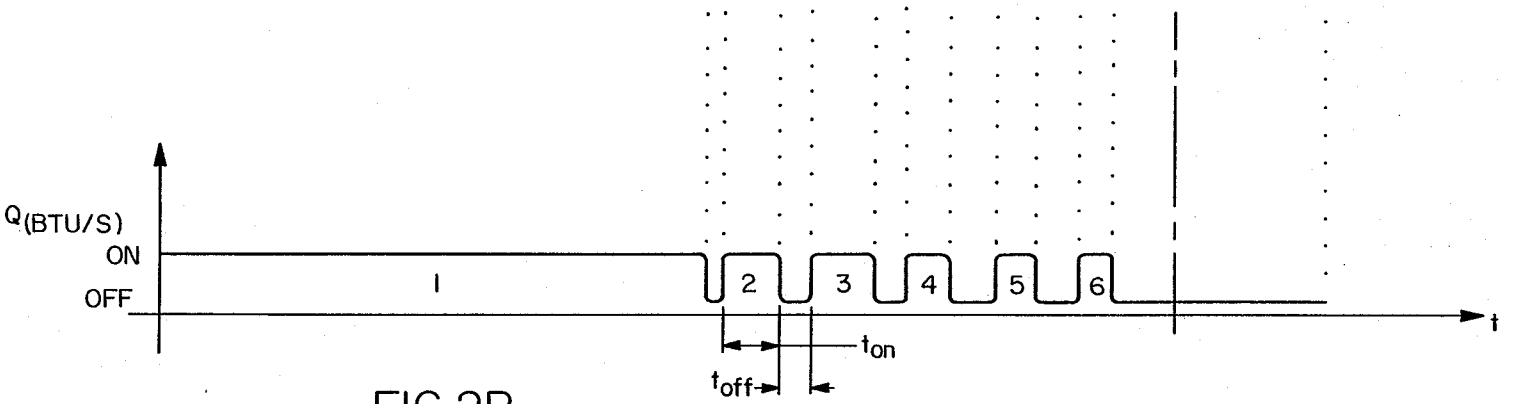
FIG. 2B illustrates the on/off time for the burner used to heat the drying air during the drying cycle.
Figure 3A:
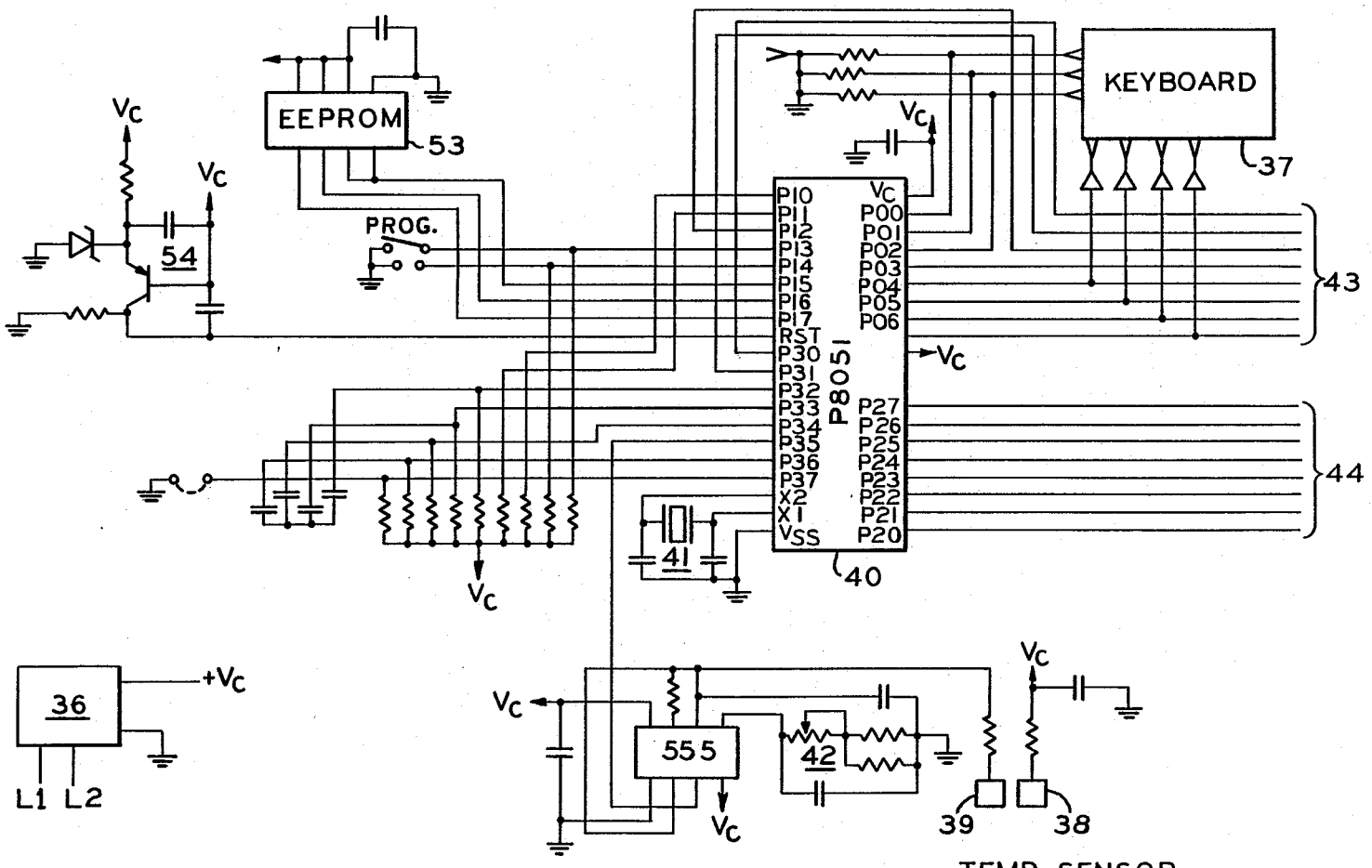
FIGS. 3A and 3B comprise a detailed schematic of the apparatus for computing the dryness level as well as establishing the set point temperature.

Referring to FIGS. 2A and 2B, there is shown the operation of the burner 16, vis a vis the temperature set point and measured temperature. FIG. 2A illustrates how initially during a beginning drying cycle the temperature of the drying chamber 12 increases until the set point is reached, $T_s$(° F). The sensor 32, which will be explained in greater detail regarding FIG. 3A, is a two terminal IC temperature transducer having plus or minus 0.5° C. calibration accuracy, monitors the drying air temperature. Once the drying air temperature as sensed by sensor 32 reaches the set point, the burner control 17 is disabled, as is illustrated in FIG. 2B. The drying chamber 12 will begin to cool down, and due to the thermal capacity of the drying chamber 12, the actual temperature within the chamber 12 will decrease approximately 3° below the set point before it is sensed by the sensor 32. At this time, the exhaust sensor 32 will have detected the temperature as being less than the set point, and another second ENABLE signal will be generated for burner control 17. As is illustrated in FIG. 2B, burner control circuit 17 enables the burner again for a period of time sufficient to sense a temperature increase to the set point temperature.

As the foregoing FIGS. 2A and 2B illustrate, it is possible to maintain the drying temperature to within a 3° F. range of the desired set point. Enough BTU heat is added to the drying air to maintain drying at this desired temperature.

As the load in the drying chamber 12 loses moisture, the amount of heat necessary to maintain the temperature at the set point decreases. As is illustrated in FIG. 2B, as the drying time increases, the burner is enabled for a lesser amount of time.

Figure 2C:
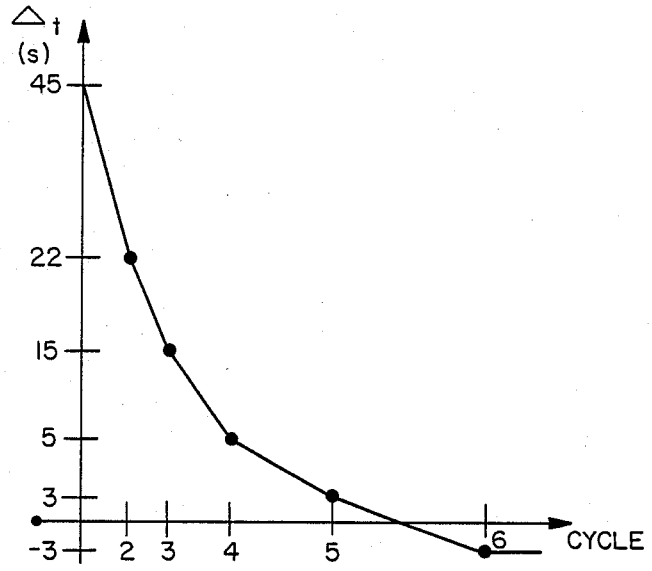
FIG. 2C illustrates the differential between on time and off time for the burner for a drying cycle.
Figure 2D:
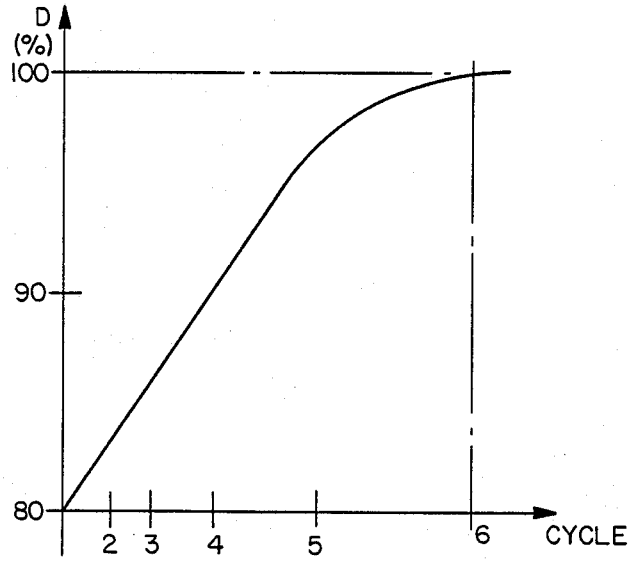
FIG. 2D illustrates the level of dryness achieved over a drying cycle and the relationship between dryness between time on minus time off computations of FIG. 2C.

FIG. 2C illustrate the difference between the burner time on and time off over a typical drying cycle. FIG. 2D illustrates the percent of dryness of the load over the same time interval. It is clear from these two Figures that there is a relationship between $\Delta t$, time on minus time off for the burner, and the dryness level of the load. Thus, by accurately monitoring $\Delta t$, one can precisely estimate the percent dryness level of the clothing load.

This relationship, shown in FIG. 2C of time on minus time off for the burner, can be directly related to a desired dryness level. Considering the dryer in a thermo-dynamic model the amount of heat added to the system, $Q_{in}$ for instance, equals the amount of heat exhausted $Q_{out}$ plus the amount of heat stored $Q_s$.

$Q_{in}$, the total heat added to the drying chamber, will equal $Q_{out}$ until dryness is equal to 100% (no moisture content). Once the load is dry, $Q_s$ will start to increase in relative proportion with respect to $Q_{in}$. The difference $\Delta t$ in time on minus time off can be expressed in terms of the following relationship:

$$\Delta t = \frac{Ts}{a} + b - d$$

where $\Delta t$ is the time on minus time off, Ts is the set point temperature, a is a thermal coefficient determined experimentally for the given machine, and b is a second experimentally determined factor.

It has been determined that for a set point temperature range of 160°-200° F. that "a" would be in the range of 2 to 9 and "b" 50–81. "d" represents the percent dryness of the load. "d" can be expressed at 90–100, depending on the percent dryness, 90 being 90% dry and 100 being 100% dry. Experimentally, this means that 90% for example represents 10% water in the load, whereas 100% represents 0% water in the load. For 200° F., a preferred value for a is 5, and for b a preferred value is 75, for a dryer having a load capacity of 100 lbs. of dry clothes.

Using the foregoing relationship, and solving for "d", dryness, it is possible to determine the real time dryness for the load in drying chamber 12 by monitoring the time on minus time off Δt. Once the electronic controller 35 has determined from Δt that a desired dryness level has been obtained, it is then possible to enter a cool down cycle for the dryer, terminating the drying cycle.

Figure 3B:
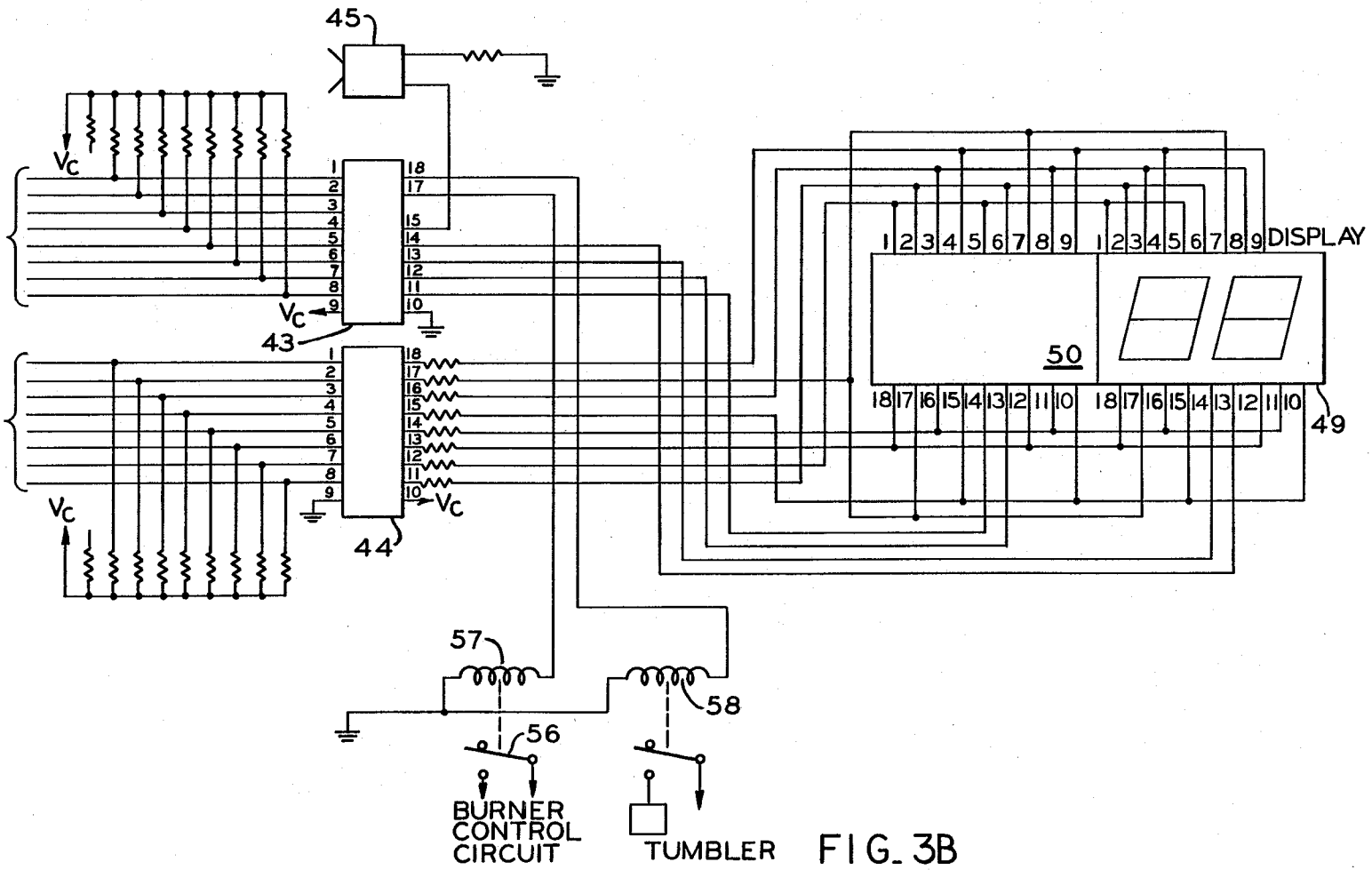

Referring to FIGS. 3A and 3B, there is shown in greater detail the electronic controller 35. Electronic controller 35 will calculate the foregoing Δt and associated dryness level, based on the current provided by temperature sensor 32. The temperature sensor 32 may be the Analog Devices type AD-590 two terminal integrated circuit temperature transducer. The device is basically a current source as described in the literature of Analog Devices. The device is connected across terminals 38 and 39. Terminal 38 is connected through a 10 OHM resistor to a source of DC potential for operating the current source. The derived current is applied to the input of an integrated circuit 555, also made by Analog Devices, for converting the derived current into a pulse signal having a frequency proportional to the magnitude of the sensor current. Thus, as the sensed exhaust temperature changes, so will the current supplied by temperature sensor 32, and the frequency of the signal applied to P35 of the microprocessor 40 which is the well known P8051. Microprocessor 40 has a clock signal derived from the piezoelectric transducer 41 with a frequency of 3.579 megacycles. The 8051 will sample the signal appearing on P35 and from the sampled signal, determine the frequency, and therefore the temperature being sensed. The nominal frequency of the integrated circuit 555 output signal may be trimmed by setting potentiometer 42.

The programmable microprocessor 40 is shown associated with two decoders 43, 44 and an audio transducer 45. A display 49 is also provided, connected to the decoders through a display drive 50 for periodically displaying a computed dryness level, or a sensed temperature under control of the system operator. The keyboard input is shown on terminals 52 to permit selection of the display as being either a computed dryness level or sensed temperature.

An EEPROM 53 is provided to store the constants a and b for use in determining the dryness level from the sensed temperature, and time differential Δt.

Standard circuitry appearing on FIG. 3 includes a reset generator 54 for being certain the reset line RST is held to an appropriate logic level at the time of enablement.

The decoders 43, 44 provide outputs for controlling the burner controller 17. The burner controller 17 is operated from the closure of contacts 56 which is associated with the relay 57. The energization of relay 57 occurs when the microprocessor 40 has determined that the temperature has fallen below the set point. A second relay 58 is shown which enables the tumbler motor control circuit 24 to energize the tumbler motor 15. This, of course, is analogous to the signal line entering the tumbler motor control 24 of FIG. 1, and is not part of the current invention.

Figure 4:
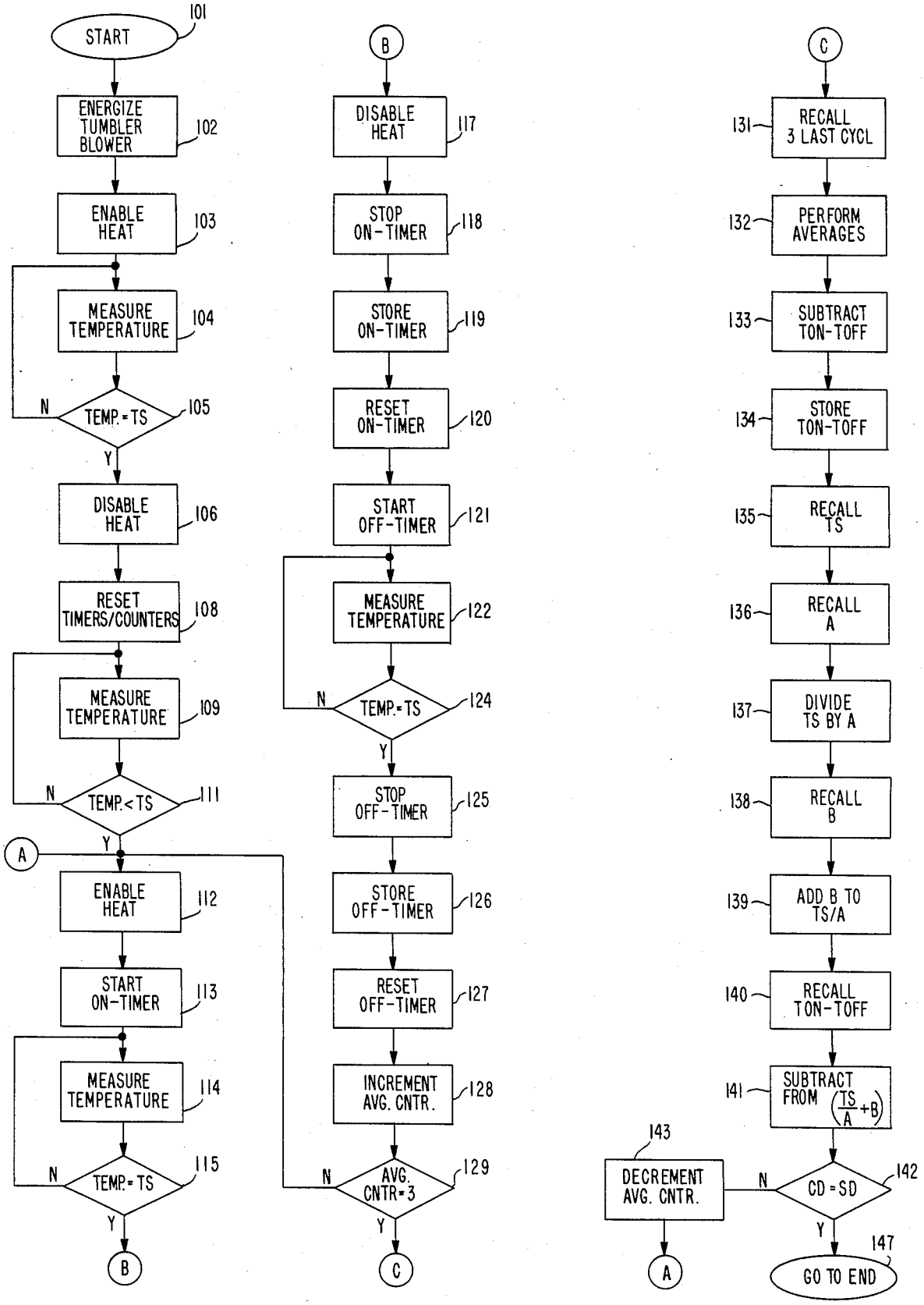
FIG. 4 is a block diagram of the programming steps executed by the microprocessor of FIGS. 3A and 3B to calculate dryness level.

The foregoing microprocessor 40 can be programmed to continuously sense the temperature, provide the necessary control for the burner control 17, as well as compute dryness levels. FIG. 4 illustrates the programming scheme for the microprocessor which will implement these functions.

Referring now to FIG. 4, there is shown the sequence of programming steps executed by the microprocessor. Block 101 illustrates the beginning of a drying cycle. The tumbler motor is energized in block 102 and an ENABLE signal applied to the burner control circuit 17. Initially, the temperature will increase from ambient to the set point as shown in the early part of the temperature curve of FIG. 2A.

The exhaust air temperature is continuously measured in step 104 when the microprocessor samples the port P35 at periodic intervals. The frequency of the signal appearing on port P35 will be proportional to the exhaust air temperature.

Once the temperature has been determined equal to the set point temperature in decision block 105, the heat is disabled in 106. Referring again to FIG. 2A, this would comprise the first time since initialization that the burner is turned off, delivering no additional heat. This will also begin the reset of the timer counters 108. These timer counters will be used to measure the time on and time off for the burner.

The temperature is again measured in 109 and when it drops below the set point, decision block 111 will indicate that it is time to enable the burner. Block 112 illustrates the presence of an ENABLE signal on the burner control circuit 17 enable line. At this point, a timer is started in block 113 to time the duration of the burners on time. The temperature is continuously measured in step 114 by periodically measuring the signal frequency on P35 and when the temperature is found to equal the set point temperature, the burner is disabled in step 117 by removing the ENABLE from the burner control circuit 17. The on timer is stopped in step 118 and the elapsed time is stored in step 119 in an internal memory location for the microprocessor 40. The on timer is reset in step 120 and the duration of time during which the burner is off is measured with the initialization of the off timer 121.

Additional temperature measurements are made in step 122, and when decision block 124 indicates that the temperature has reached the set point temperature, the off timer is stopped in step 125 and its recorded time stored in step 126. A reset of the off timer occurs in step 127.

An average counter is provided in the microprocessor 40 which will keep track of the number of on and off times, comprising a burner cycle, which occurs after the initial set point temperature has been reached. In step 128, this counter is incremented and checked to see whether or not it has been incremented three times. If not, the control of the program goes back to block 112 and further burner cycles are effected in response to a comparison of the set point temperature and measured temperature. After three complete burner cycles have been completed, decision block 129 will transfer control to block 131. At this time, there are stored three on times and three off times for the burner, representing three burner cycles. Each of the on times are averaged together to form a single on time average. The off times are averaged together to form a single off time average in step 132. The difference between these averages is taken in step 133 and stored in step 134. At this time, the program will enter into a computation of the dryness level for the load being dried. The set point temperature is recalled in step 135, constants a in step 136, and the first term of the dryness equation is determined in step 137. The second of the necessary constants 138 is recalled from the EEPROM and combined with the first computation Ts/a in step 139. Step 140 will recall the averaged time on minus time off difference and compute the dryness in step 141.

A decision block 142 will compare the computed dryness level with a desired dryness level. This dryness level may either be inputted through the keyboard control by the operator, or preprogrammed in the EEPROM. If the desired dryness has not been obtained, step 143 will decrement the average counter. Since less than three burner cycles are indicated as having been completed in the average counter, an additional burner cycle will be entered through path A.

The effect of the foregoing programming steps is to continuously recycle the burner cycle. At least three consecutive burner cycle on times and off times are stored in memory for each of the subsequent dryness calculations. Thus, the oldest on/off time is discarded, each time decision block 142 indicates the dryness level is not detected to be equal to the desired dryness level. As soon as the average counter is incremented by one, indicating a new burner cycle has been completed, a subsequent dryness level is determined. If this produces the required dryness, the decision block 142 will end the drying cycle.

Ending the drying cycle is represented by the end 147. This, of course, may initiate a standard cool down cycle, terminating the dryer operation for the given load.

The foregoing technique of measuring dryness and computing a drying cycle time based on each estimated dryness level for the load, provides for improved efficiency in fuel consumption as well as an accurate determination of the drying time. Thus, little guesswork or operator effort is required to run a load through the dryer, once the machine has been loaded. Although not indicated in FIG. 4, the calculated dryness levels can be displayed on the numerical display 38 during drying, as well as the monitored temperature level. The monitoring and displaying of these levels is, of course, possible using only routine display commands in the microprocessor software. Additionally, at the conclusion of the drying cycle, audio transducer 45 can be enabled briefly to alert the operator that the drying cycle is completed. This alert can follow the conclusion of the drying cycle, and be asserted by the microprocessor when the cool down cycle is completed.

Thus, in accordance with one embodiment there has been described an apparatus and method which will automatically compute a drying cycle based on estimated dryness of the load in a clothes dryer. Those skilled in the art will recognize yet other embodiments from the claims which follow.

What is claimed is:

1. In a clothes dryer of the type having a burner for supplying a source of hot air for drying clothes while said clothes are tumbled, apparatus for generating a drying cycle for said clothes dryer, comprising:

(a) a temperature sensor positioned in said clothes dryer to measure the temperature of said hot air;

(b) burner controller means for enabling and disabling heating of said hot air;

(c) a microprocessor connected to read a signal from said temperature sensor, said microprocessor programmed to provide an enabling signal to enable a burner to supply said hot air when said hot air temperature is below a predetermined temperature, and disable said burner when said temperature is at or above said predetermined temperature, whereby said burner is continuously cycled to maintain said hot air at a predetermined temperature, said microprocessor being programmed to periodically compute an average on time and off time for said burner, and computing the dryness of said clothes as a function of the difference between said average on time and off time, and generating a signal indicating the end of said drying cycle when a predetermined dryness is computed which disables said burner.

2. The apparatus of claim 1, wherein said temperature sensor is connected through a current to a frequency generator to said microprocessor.

3. The apparatus of claim 1 further comprising a display for periodically displaying each of said dryness computations.

4. The apparatus of claim 1 wherein said dryness is determined by calculating $$\frac{Ts}{a} + b - (Ton - Toff)$$

where Ts is said predetermined temperature, Ton is the average on time, and Toff is the average off time of said burner, and a and b are constants.

5. The apparatus of claim 1 wherein said constants a and b lie within a range of 2–9 and 50–81.

6. The apparatus of claim 1 wherein said temperature sensor is located in an exhaust port of said dryer.

7. A method for controlling a drying cycle of a hot air clothes dryer which is heated by a burner, while said clothes are being tumbled, comprising:

continuously measuring said hot air temperature while drying said clothes;

comparing said measured temperature to a fixed predetermined temperature Ts;

enabling said burner to supply heat to said hot air only when said measured temperature is less than said predetermined temperature, whereby said burner will be enabled and disabled as said hot air temperature decreases and increases about said predetermined temperature;

measuring the periods of time said burner is enabled, and the period of time said burner is disabled;

determining the difference $\Delta t$ between said periods of time said burner was enabled and disabled;

determining from said difference a dryness for said clothes; and terminating drying of said clothes when said dryness reaches a predetermined level.

8. The method of claim 7 wherein said dryness level is determined as $$\frac{Ts}{a} + b - \Delta t,$$

where a and b are constants.

9. The method of claim 8 wherein a is between 2–9 and b is between 50–81.

10. The method of claim 7 wherein a plurality of on/off times are stored, and a first average taken of said on times, and a second average is taken of said off times, and said difference is determined from said first and second averages.

* * * * *